US007023414B2

(12) United States Patent
Ham

(10) Patent No.: US 7,023,414 B2
(45) Date of Patent: Apr. 4, 2006

(54) METHOD AND APPARATUS FOR DRIVING LIQUID CRYSTAL DISPLAY

(75) Inventor: Yong Sung Ham, Kyounggi-do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 308 days.

(21) Appl. No.: 10/001,787

(22) Filed: Dec. 5, 2001

(65) Prior Publication Data

US 2003/0128176 A1 Jul. 10, 2003

(30) Foreign Application Priority Data

Sep. 4, 2001 (KR) ..... P2001-54125

(51) Int. Cl.
*G09G 3/36* (2006.01)

(52) U.S. Cl. ..... 345/98; 345/99

(58) Field of Classification Search ..... 345/87, 345/89, 94, 95, 97, 96, 98, 100, 101, 99; 349/33

See application file for complete search history.

(56) References Cited

U.S. PATENT DOCUMENTS 4,775,891 A * 10/1988 Aoki et al. ..... 348/572
5,495,265 A 2/1996 Hartman et al.
5,844,533 A * 12/1998 Usui et al. ..... 345/89

FOREIGN PATENT DOCUMENTS

WO WO 99/05567 2/1999

* cited by examiner

*Primary Examiner*—Dennis-Doon Chow
(74) *Attorney, Agent, or Firm*—McKenna Long & Aldridge LLP

(57) ABSTRACT

The present invention discloses a method and apparatus for driving a liquid crystal display device preventing a deterioration of picture quality. More specifically, in the method and apparatus, a difference between modulated data and normal input data is calculated, and the normal input data are modulated by using the difference data calculated.

10 Claims, 7 Drawing Sheets

METHOD AND APPARATUS FOR DRIVING LIQUID CRYSTAL DISPLAY

This application claims the benefit of Korean Application No. P2001-54125 filed on Sep. 04, 2001, which is hereby incorporated by reference.

BACKGROUND OF THE INVENTION

1. Field of the Invention

The present invention relates to a liquid crystal display, and more particularly, to a method and apparatus for driving a liquid crystal display. Although the present invention is suitable for a wide scope of applications, it is particularly suitable for reducing a memory size in data modulation and preventing deterioration in picture quality.

2. Discussion of the Related Art

Generally, a liquid crystal display (LCD) controls a light transmittance of each liquid crystal cell in accordance with a video signal to thereby display a picture. An active matrix LCD including a switching device for each liquid crystal cell is suitable for displaying a moving picture. The active matrix LCD uses a thin film transistor (TFT) as a switching device.

The LCD has a disadvantage in that it has a slow response time due to inherent characteristics of a liquid crystal such as a viscosity and an elasticity, etc. Such characteristics can be explained by using the following equations (1) and (2):

$$\tau_r \propto \gamma d^2/\Delta\epsilon|V_a^2-V_F^2| \quad (1)$$

where $\tau_r$ represents a rising time when a voltage is applied to a liquid crystal, $V_a$ is an applied voltage, $V_F$ represents a Freederick transition voltage at which liquid crystal molecules begin to perform an inclined motion, d is a cell gap of liquid crystal cells, and $\gamma$ represents a rotational viscosity of the liquid crystal molecules.

$$\tau_f \propto \gamma d^2/K \quad (2)$$

where $\tau_f$ represents a falling time at which a liquid crystal is returned into an initial position by an elastic restoring force after a voltage applied to the liquid crystal was turned off, and K is an elastic constant.

A twisted nematic (TN) mode liquid crystal has a different response time due to physical characteristics of the liquid crystal and a cell gap, etc. Typically, the TN mode liquid crystal has a rising time of 20 to 80 ms and a falling time of 20 to 30 ms. Since such a liquid crystal has a response time longer than one frame interval (i.e., 16.67 ms in the case of NTSC system) of a moving picture, a voltage charged in the liquid crystal cell is progressed into the next frame prior to arriving at a target voltage. Thus, due to a motion-blurring phenomenon, a moving picture is blurred out on the screen.

Referring to FIG. 1, the conventional LCD cannot express desired color and brightness. Upon implementation of a moving picture, a display brightness BL fails to arrive at a target brightness corresponding to a change of the video data VD from one level to another level due to its slow response time. Accordingly, a motion-blurring phenomenon appears from the moving picture and a display quality is deteriorated in the LCD due to a reduction in a contrast ratio.

In order to overcome such a slow response time of the LCD, U.S. Pat. No. 5,495,265 and PCT International Publication No. WO99/05567 have suggested to modulate data in accordance with a difference in the data by using a look-up table, (hereinafter referred to as high-speed driving scheme). This high-speed driving scheme allows data to be modulated by a principle as shown in FIG. 2.

Referring to FIG. 2, a conventional high-speed driving scheme modulates input data VD and applies the modulated data MVD to the liquid crystal cell, thereby obtaining a desired brightness MBL. In the high-speed driving scheme, $|V_a^2-V_F^2|$ is increased from the above equation (1) on the basis of a difference of the data so that a desired brightness can be obtained in response to a brightness value of the input data within one frame period. Accordingly, the LCD employing such a high-speed driving scheme compensates for a slow response time of the liquid crystal by modulating a data value in order to alleviate a motion-blurring phenomenon from a moving picture, thereby displaying a picture at desired color and brightness.

In other words, when there is a change upon the comparison of the most significant bit data MSB of the previous frame Fn−1 and the most significant bit data MSB of the current frame Fn, the high-speed driving scheme selects the modulated data Mdata corresponding to the look-up table and modulates as shown in FIG. 3. Such a high-speed driving scheme only modulates a few high order bits for reducing the load of the memory size upon implementation of hardware. The high-speed driving scheme implemented in this way is shown in FIG. 4.

Referring to FIG. 4, a conventional high-speed driving apparatus includes a frame memory 43 connected to a most significant (or high-order) bit bus line 42 and a look-up table 44 connected to the most significant bit bus line 42 and the frame memory 43.

The frame memory 43 stores most significant bit data MSB during one frame period and supplies the stored data to the look-up table 44. Herein, the most significant bit data MSB are high-order 4 bits in source data RGB Data In having 8 bits.

The look-up table 44 compares the most significant bit data of the current frame Fn inputted from the most significant bit bus line 42, with the most significant bit data of the previous frame Fn−1 inputted from the frame memory 43 in Table 1 or Table 2, and selects the corresponding modulated data Mdata. The modulated data Mdata are added to the least significant (or low-order) bit data from a least significant bit bus line, and supplied to a liquid crystal display.

TABLE 1

| | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 0 | 0 | 1 | 3 | 4 | 6 | 7 | 9 | 10 | 11 | 12 | 14 | 15 | 15 | 15 | 15 | 15 |
| 1 | 0 | 1 | 2 | 4 | 5 | 7 | 9 | 10 | 11 | 12 | 13 | 14 | 15 | 15 | 15 | 15 |
| 2 | 0 | 1 | 2 | 3 | 5 | 7 | 8 | 9 | 10 | 12 | 13 | 14 | 15 | 15 | 15 | 15 |
| 3 | 0 | 1 | 2 | 3 | 5 | 6 | 8 | 9 | 10 | 11 | 12 | 14 | 14 | 15 | 15 | 15 |
| 4 | 0 | 0 | 1 | 2 | 4 | 6 | 7 | 9 | 10 | 11 | 12 | 13 | 14 | 15 | 15 | 15 |
| 5 | 0 | 0 | 0 | 2 | 3 | 5 | 7 | 8 | 9 | 11 | 12 | 13 | 14 | 15 | 15 | 15 |
| 6 | 0 | 0 | 0 | 1 | 3 | 4 | 6 | 8 | 9 | 10 | 11 | 13 | 14 | 15 | 15 | 15 |
| 7 | 0 | 0 | 0 | 1 | 2 | 4 | 5 | 7 | 8 | 10 | 11 | 12 | 14 | 14 | 15 | 15 |
| 8 | 0 | 0 | 0 | 1 | 2 | 3 | 5 | 6 | 8 | 9 | 11 | 12 | 13 | 14 | 15 | 15 |

TABLE 1-continued

| | | | | | | | | | | | | | | | | |
|---|---|---|---|---|---|---|---|---|---|---|---|---|---|---|---|---|
| 9 | 0 | 0 | 0 | 1 | 2 | 3 | 4 | 6 | 7 | 9 | 10 | 12 | 13 | 14 | 15 | 15 |
| 10 | 0 | 0 | 0 | 0 | 1 | 2 | 4 | 5 | 7 | 8 | 10 | 11 | 13 | 14 | 15 | 15 |
| 11 | 0 | 0 | 0 | 0 | 0 | 2 | 3 | 5 | 6 | 7 | 9 | 11 | 12 | 14 | 15 | 15 |
| 12 | 0 | 0 | 0 | 0 | 0 | 1 | 3 | 4 | 5 | 7 | 8 | 10 | 12 | 13 | 15 | 15 |
| 13 | 0 | 0 | 0 | 0 | 0 | 1 | 2 | 3 | 4 | 6 | 8 | 10 | 11 | 13 | 14 | 15 |
| 14 | 0 | 0 | 0 | 0 | 0 | 0 | 1 | 2 | 3 | 5 | 7 | 9 | 11 | 13 | 14 | 15 |
| 15 | 0 | 0 | 0 | 0 | 0 | 0 | 0 | 1 | 2 | 4 | 6 | 9 | 11 | 13 | 14 | 15 |

In Table 1, a left column is for a data voltage VDn−1 of the previous frame Fn−1 while an uppermost row is for a data voltage VDn of the current frame Fn.

Thus, in the high-speed driving scheme which only modulates 4 bits of the most significant bit data MSB, a data width of the frame memory 43 and the look-up table 44 is 4 bits.

But, if the data width of the look-up table 44 is limited to the number of the bits of the most significant bit data MSB, the modulated data value registered at the look-up table 44 is limited accordingly. For example, if the modulated data value of a high gray level does not have a desirable value and is limited to lower than that, a picture quality is deteriorated because the brightness desired can be obtained in the high gray level.

To reduce such a deterioration and to modulate the data in a desirable way, a data width of the modulated data registered at the look-up table 44 should be large enough and the inputted source data should be compared by full bits (8 bits). It is inevitable to increase the memory size of the look-up table 44 for this purpose. That is, if the full bits (8 bits) data is inputted to the look-up table 44 from each of the previous frame Fn−1 and the current frame Fn and the modulated data registered at the look-up table 44 is set to the full bits (8 bits), the memory size of the look-up table 44 become 65536×8=524,000 bits. Herein, in the foregoing equation, the first term '65536' is a multiplication (256×256) of each full bit source data of the previous frame Fn−1 and the current frame Fn, the second term '8' is the data width (8 bits) of the modulated data registered at the look-up table 44.

SUMMARY OF THE INVENTION

Accordingly, the present invention is directed to a method and apparatus for driving a liquid crystal display that substantially obviates one or more of problems due to limitations and disadvantages of the related art.

Another object of the present invention is to provide a method and apparatus for driving a liquid crystal display that reduces a memory size in data modulation and preventing deterioration in picture quality.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a method of driving a liquid crystal display includes setting modulated data in advance in the liquid crystal display, calculating a difference between the modulated data and normal input data, and modulating the normal input data by using the calculated difference.

In the method, the difference is an absolute value.

The method further includes adding the modulated data and the normal input data, and performing a subtraction operation between the modulated data and the normal input data.

The method further includes delaying the normal input data, comparing the delayed normal input data with the normal input data, and selecting one of the added data and the subtracted data depending on the compared result.

In the method, the selected data are equal to the modulated data set in advance. In the method, the normal input data are added with the modulated data that are generated by modulating the normal input data.

A method of driving a liquid crystal display includes dividing the normal input data into most significant bits and least significant bits, delaying the most significant bits for a frame period, adding the modulated data with non-delayed most significant bits, performing a subtraction operation between the modulated data and the non-delayed most significant bits, comparing the delayed most significant bits with the non-delayed most significant bits, and selecting one of the added data and the subtracted data depending on the compared result, thereby outputting the modulated data.

The method further includes dividing the normal input data into most significant bits and least significant bits, delaying the most significant bits for a frame period, and adding non-delayed most significant bits and the modulated data generated by modulating the normal input data, thereby outputting the modulated data set in advance.

In the method, the modulated data are selected in accordance with a change between the delayed data and the non-delayed data.

In another aspect of the present invention, a driving apparatus for a liquid crystal display includes an input line receiving normal input data, and a modulator modulating the normal input data by using subtracted data between modulated data set in advance and the normal input data from the input line.

In the driving apparatus, the subtracted data are used as an absolute value.

The driving apparatus further includes an adder adding the modulated data and the normal input data, and a subtracter performing a subtraction operation between the modulated data and the normal input data.

The driving apparatus further includes a frame memory delaying the normal input data, a comparator comparing the normal input data with the delayed normal input data for a frame period, and a selector selecting one of the added data and the subtracted data depending on the compared result from the comparator.

The selected data are equal to the modulated data set in advance.

The driving apparatus further includes an adder adding the modulated data with the normal input data to output the modulated data set in advance.

The driving apparatus further includes a frame memory delaying most significant bits of the normal input data, an adder adding the modulated data and the non-delayed most significant bits, a subtracter performing a subtraction operation between the modulated data and the non-delayed most significant bits, a comparator comparing the delayed most significant bits with the non-delayed most significant bits, and a selector selecting one of the added data and the subtracted data depending on the compared result.

The driving apparatus further includes a frame memory delaying most significant bits of the normal input data, and an adder adding the modulated data with the non-delayed most significant bits to output the modulated data set in advance.

The modulated data are selected in accordance with a change between the delayed data and the non-delayed data.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

In the drawings.

DETAILED DESCRIPTION OF THE ILLUSTRATED EMBODIMENTS

Reference will now be made in detail to the illustrated embodiments of the present invention, examples of which are illustrated in the accompanying drawings. Wherever possible, the same reference numbers will be used throughout the drawings to refer to the same or like parts.

A driving apparatus for a liquid crystal display (LCD) according to the present invention will be explained with reference to FIGS. 5 to 10.

Figure 1:
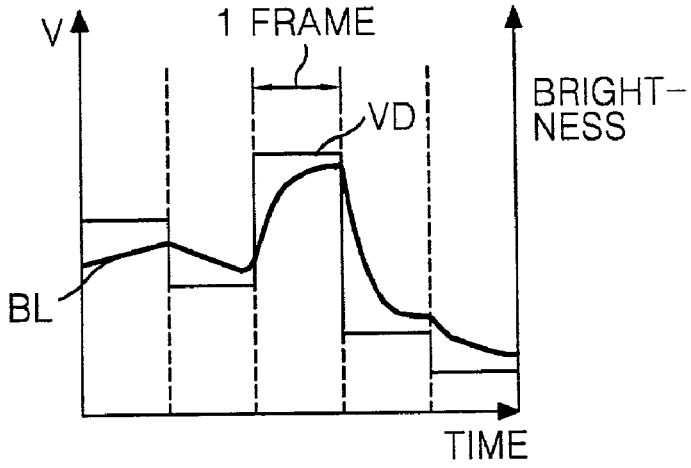
FIG. 1 CONVENTIONAL ART
FIG. 1 is a waveform diagram showing a brightness variation with respect to an applied voltage according to a conventional liquid crystal display.
Figure 2:
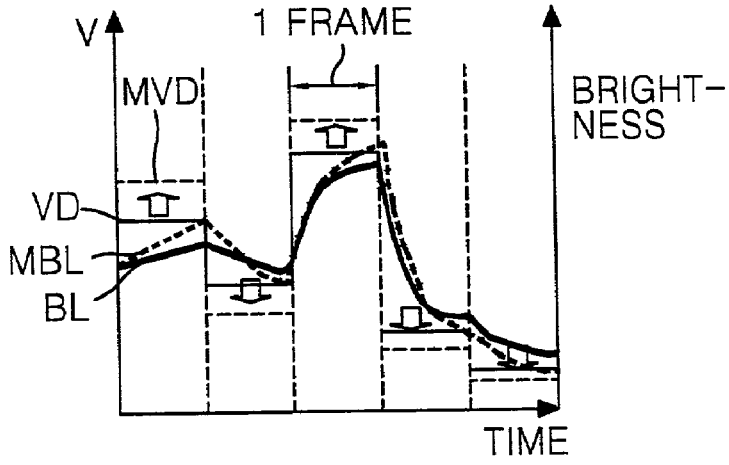
FIG. 2 CONVENTIONAL ART
FIG. 2 is a waveform diagram showing a brightness variation with respect to an applied voltage according to a conventional high-speed driving scheme.
Figure 3:
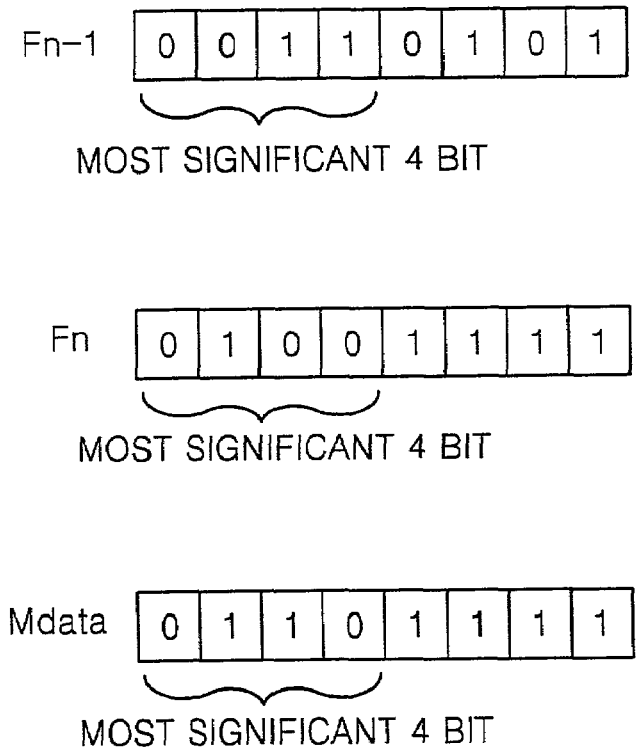
FIG.3 CONVENTIONAL ART
FIG. 3 illustrates a schematic diagram for a conventional high-speed driving scheme for 8 bit data.
Figure 4:
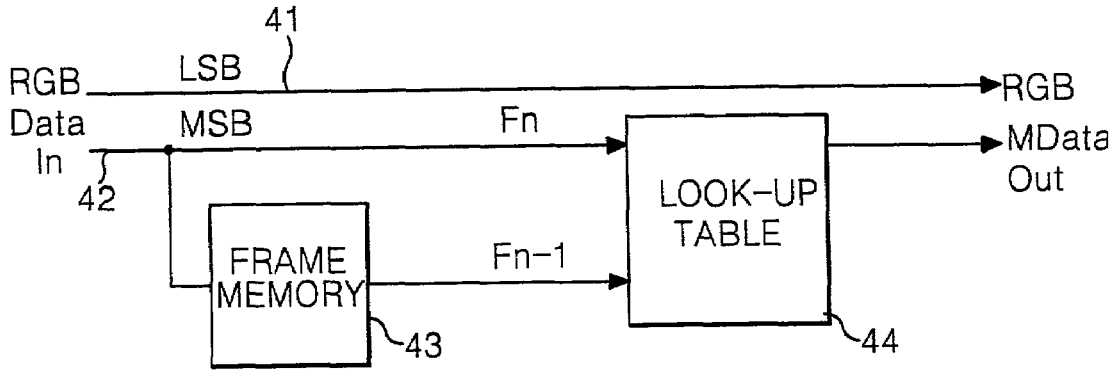
FIG.4 CONVENTIONAL ART
FIG. 4 is a block diagram showing a configuration of a conventional high-speed driving apparatus.
Figure 5:
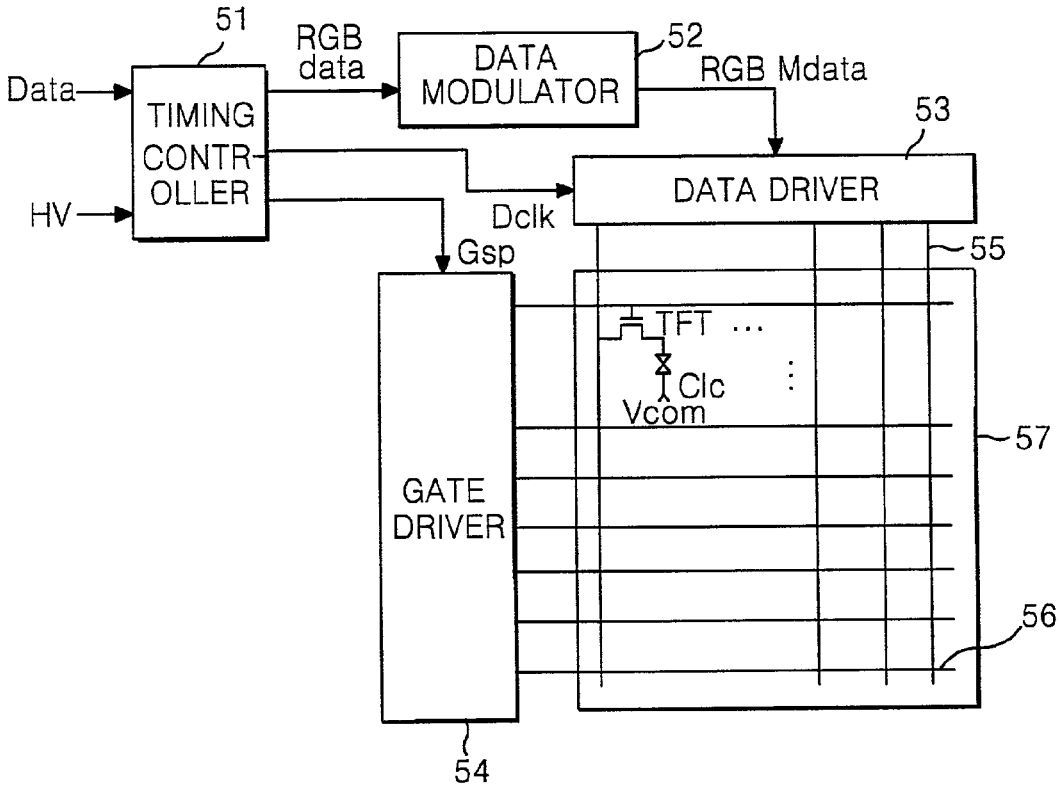
FIG. 5 is a block diagram showing a configuration of a driving apparatus for a liquid crystal display according to the present invention.

Initially referring to FIG. 5, a driving apparatus for a liquid crystal display according to the present invention includes a liquid crystal display panel 57 on which a thin film transistor TFT is formed at the intersection. A plurality of data lines 55 and gate lines 56 are provided thereon to drive a liquid crystal cell Clc. A data driver 53 supplies data to the data lines 55 of the liquid crystal display panel 57. A gate driver 54 supplies a scanning pulse to the gate lines 56 of the liquid crystal panel 57. A timing controller 51 receives digital video data and horizontal and vertical synchronizing signals H and V. A data modulator 52 is connected between the timing controller 51 and the data driver 53 for modulating input data (RGB data).

More specifically, the liquid crystal display panel 57 has a liquid crystal formed between two glass substrates. The data lines 55 and the gate lines 56 are formed on the liquid crystal display panel 57 to perpendicularly cross each other. The TFT formed at the intersection of the data lines 55 and the gate lines 56 responds to the scanning pulse and supplies the data through the data lines 55 to the liquid crystal cell Clc. For this purpose, a gate electrode of the TFT is connected to the gate lines 56, a source electrode is connected to the data lines 55, and a drain electrode is connected to a pixel electrode of the liquid crystal cell Clc.

The timing controller rearranges digital video data supplied from a digital video card (not shown). The data rearranged by the timing controller 51 are supplied to the data modulator 52. Also, by using horizontal and vertical synchronization signals, the timing controller 51 generates a polarity control signal and a timing control signal, such as dot clock Dclk, a gate start pulse GSP, a gate shift clock GSC (not shown) and an output enable/disable signal, to control the data driver 53 and the gate driver 54. The dot clock Dclk and the polarity control signal are supplied to the data driver 53. The gate start pulse GSP and the gate shift clock GSC are supplied to the gate driver 54.

The gate driver 54 includes a shift register sequentially generating a scanning pulse, namely a gate high pulse, in response to the gate start pulse GSP and the gate shift clock GSC supplied from the timing controller 51, and a level shifter shifting a voltage of the scanning pulse into a level suitable for driving the liquid crystal cell Clc. The TFT is turned on in response to the scanning pulse to apply video data through the data line 55 to the pixel electrode of the liquid crystal cell Clc.

The data driver 53 is supplied with red (R), green (G), and blue (B) modulated data (RGB Mdata) modulated by the data modulator 52 and receives a dot clock Dclk from the timing controller 51. The data driver 53 samples the red (R), green (G), and blue (B) modulated data (RGB Mdata) in accordance with the dot clock Dclk and thereafter latches the modulated data line by line. The latched data by the data driver 53 are converted into analog data to apply to the data lines 55 at every scanning interval. Further, the data driver 53 may apply a gamma voltage corresponding to the modulated data to the data line 55.

The data modulator 52 modulates the inputted current data RGB data by using a look-up table corresponding to a difference in the RGB data of a previous frame Fn−1 and a current frame Fn. The modulated data registered at the look-up table is an absolute value of the difference which is calculated by subtracting normal driving data from the modulated data set for a high-speed driving scheme, or the difference value. Herein, the normal driving data represents normal data without a data modulation.

Figure 6:
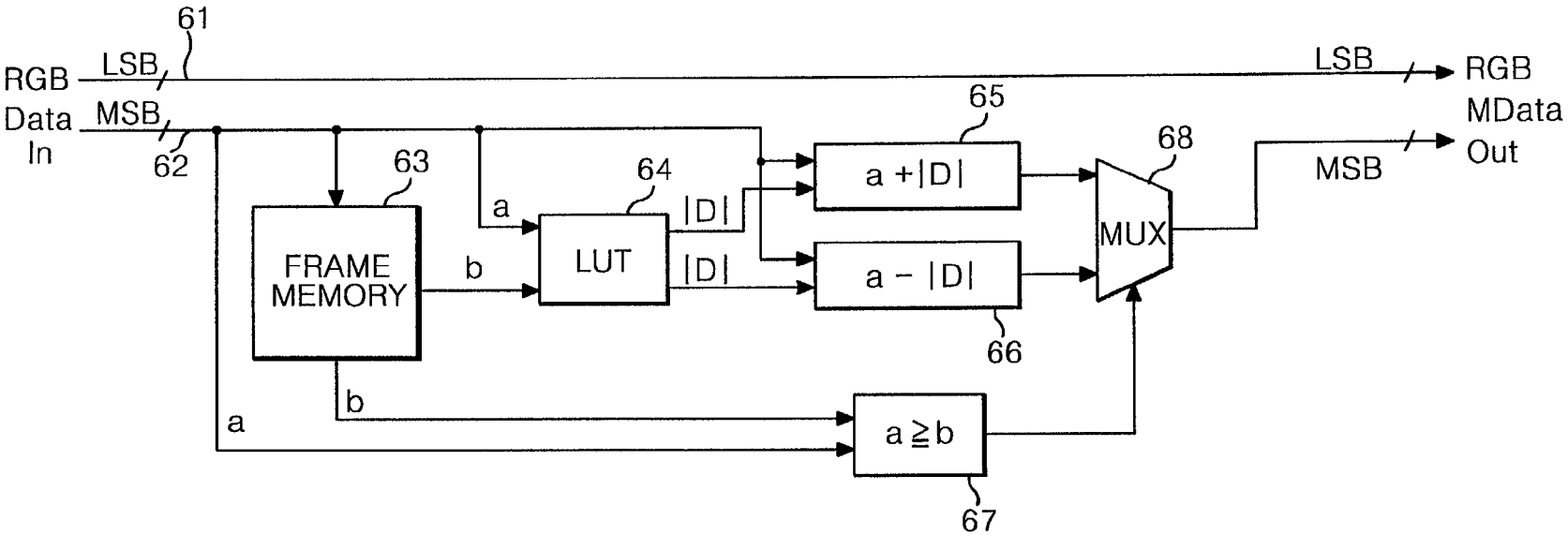
FIG. 6 is a block diagram of a data modulator shown in FIG. 5 according to a first embodiment of the present invention.

FIG. 6 illustrates a data modulator 52 according to a first embodiment of the present invention.

Referring to FIG. 6, the data modulator 52 according to the first embodiment includes a frame memory 63 receiving most significant bit data MSB from the timing controller 51 (shown in FIG. 5). A look-up table 64 modulates the most significant bit data MSB by using an absolute value of the difference calculated by subtracting the normal driving data from the modulated data suitable for a high-speed driving scheme. An adder 65 adds the modulated data from the look-up table LUT 64 and the data from a significant bit bus line 62. A subtracter performs a subtraction operation between the modulated data from the look-up table 64 and the data from the most significant bit bus line 62. A multiplexer (hereafter, MUX) selects one of the output of the adder 65 and the subtracter 66. A comparator 67 controls the MUX 68.

More specifically, the frame memory 63 is connected to the most significant bit bus line 62 of the timing controller 51 and stores the most significant bit data MSB inputted from the timing controller 51 for one frame period. The frame memory 63 supplies the stored most significant bit data MSB to the look-up table 64 every frame.

The modulated data determined as the absolute value of the difference, which is calculated by subtracting the inputted current normal driving data from the data set for the high-speed driving scheme.

Assuming that the frame memory 63 and the most significant bit data MSB inputted from the look-up table 64 are 4 bits each, the modulated data registered at the look-up table LUT 64 are determined as an absolute value of the difference which is calculated by subtracting the normal driving data Table 2 from Table 1. The modulated data determined as an absolute value thereof, are shown in Table 3.

In Table 2, video data driven normally without any modulation are rearranged therein.

TABLE 2

| | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 0 | 0 | 1 | 2 | 3 | 4 | 5 | 6 | 7 | 8 | 9 | 10 | 11 | 12 | 15 | 15 | 15 |
| 1 | 0 | 1 | 2 | 3 | 4 | 5 | 6 | 7 | 8 | 9 | 10 | 11 | 12 | 15 | 15 | 15 |
| 2 | 0 | 1 | 2 | 3 | 4 | 5 | 6 | 7 | 8 | 9 | 10 | 11 | 12 | 15 | 15 | 15 |
| 3 | 0 | 1 | 2 | 3 | 4 | 5 | 6 | 7 | 8 | 9 | 10 | 11 | 12 | 15 | 15 | 15 |
| 4 | 0 | 1 | 2 | 3 | 4 | 5 | 6 | 7 | 8 | 9 | 10 | 11 | 12 | 15 | 15 | 15 |
| 5 | 0 | 1 | 2 | 3 | 4 | 5 | 6 | 7 | 8 | 9 | 10 | 11 | 12 | 15 | 15 | 15 |
| 6 | 0 | 1 | 2 | 3 | 4 | 5 | 6 | 7 | 8 | 9 | 10 | 11 | 12 | 15 | 15 | 15 |
| 7 | 0 | 1 | 2 | 3 | 4 | 5 | 6 | 7 | 8 | 9 | 10 | 11 | 12 | 15 | 15 | 15 |
| 8 | 0 | 1 | 2 | 3 | 4 | 5 | 6 | 7 | 8 | 9 | 10 | 11 | 12 | 15 | 15 | 15 |
| 9 | 0 | 1 | 2 | 3 | 4 | 5 | 6 | 7 | 8 | 9 | 10 | 11 | 12 | 14 | 15 | 15 |
| 10 | 0 | 1 | 2 | 3 | 4 | 5 | 6 | 7 | 8 | 9 | 10 | 11 | 12 | 14 | 15 | 15 |
| 11 | 0 | 1 | 2 | 3 | 4 | 5 | 6 | 7 | 8 | 9 | 10 | 11 | 12 | 14 | 15 | 15 |
| 12 | 0 | 1 | 2 | 3 | 4 | 5 | 6 | 7 | 8 | 9 | 10 | 11 | 12 | 14 | 15 | 15 |
| 13 | 0 | 1 | 2 | 3 | 4 | 5 | 6 | 7 | 8 | 9 | 10 | 11 | 12 | 13 | 15 | 15 |
| 14 | 0 | 1 | 2 | 3 | 4 | 5 | 6 | 7 | 8 | 9 | 10 | 11 | 12 | 12 | 14 | 15 |
| 15 | 0 | 1 | 2 | 3 | 4 | 5 | 6 | 7 | 8 | 9 | 10 | 11 | 12 | 11 | 13 | 15 |

TABLE 3

| | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 0 | 0 | 0 | 1 | 1 | 2 | 2 | 3 | 3 | 3 | 3 | 4 | 4 | 3 | 2 | 1 | 0 |
| 1 | 0 | 0 | 0 | 1 | 1 | 2 | 3 | 3 | 3 | 3 | 3 | 3 | 3 | 2 | 1 | 0 |
| 2 | 0 | 0 | 0 | 0 | 1 | 2 | 2 | 2 | 2 | 3 | 3 | 3 | 3 | 2 | 1 | 0 |
| 3 | 0 | 0 | 0 | 0 | 1 | 1 | 2 | 2 | 2 | 2 | 2 | 3 | 2 | 2 | 1 | 0 |
| 4 | 0 | 1 | 1 | 1 | 0 | 1 | 1 | 2 | 2 | 2 | 2 | 2 | 2 | 2 | 1 | 0 |
| 5 | 0 | 1 | 2 | 1 | 1 | 0 | 1 | 1 | 1 | 2 | 2 | 2 | 2 | 2 | 1 | 0 |
| 6 | 0 | 1 | 2 | 2 | 1 | 1 | 0 | 1 | 1 | 1 | 1 | 2 | 2 | 2 | 1 | 0 |
| 7 | 0 | 1 | 2 | 2 | 2 | 1 | 1 | 0 | 0 | 1 | 1 | 1 | 2 | 1 | 1 | 0 |
| 8 | 0 | 1 | 2 | 2 | 2 | 2 | 1 | 1 | 0 | 0 | 1 | 1 | 1 | 1 | 1 | 0 |
| 9 | 0 | 1 | 2 | 2 | 2 | 2 | 2 | 1 | 1 | 0 | 0 | 1 | 1 | 1 | 1 | 0 |
| 10 | 0 | 1 | 2 | 3 | 3 | 3 | 2 | 2 | 1 | 1 | 0 | 0 | 1 | 1 | 1 | 0 |
| 11 | 0 | 1 | 2 | 3 | 4 | 3 | 3 | 2 | 2 | 2 | 1 | 0 | 0 | 1 | 1 | 0 |
| 12 | 0 | 1 | 2 | 3 | 4 | 4 | 3 | 3 | 3 | 2 | 2 | 1 | 0 | 0 | 1 | 0 |
| 13 | 0 | 1 | 2 | 3 | 4 | 4 | 4 | 4 | 4 | 3 | 2 | 1 | 1 | 0 | 0 | 0 |
| 14 | 0 | 1 | 2 | 3 | 4 | 5 | 5 | 5 | 5 | 4 | 3 | 2 | 1 | 0 | 0 | 0 |
| 15 | 0 | 1 | 2 | 3 | 4 | 5 | 6 | 6 | 6 | 5 | 4 | 2 | 1 | 0 | 0 | 0 |

In Table 2 and Table 3, a left column is for a data voltage VDn−1 of the previous frame Fn−1 while an uppermost row is for a data voltage VDn of the current frame Fn.

As shown in Table 3, a data width of the look-up table LUT 64 according to the present invention can be set to 3 bits because the data (hereafter, look-up table data) registered at the look-up table do not exceed 6. In this case, the memory size of the look-up table LUT 64 requires only 256×3=768 bits. Herein, the first term 256 of the foregoing equation is a multiplication (16×16) of the source data of an each 4 bit most significant bit data MSB of the previous frame Fn−1 and the current frame Fn. The second term 3 of the foregoing equation is the data width (3 bits) of the modulated data of Table 3 registered in the look-up table 64. In case where the most significant bit data MSB are set to 4 bits, the memory size of the look-up table LUT is 256×4=1024 in the conventional high-speed driving scheme.

To obtain the modulated data suitable for the high-speed driving scheme as shown in Table 1, the look-up table data of Table 3 should be subtracted from or added with the most significant bit data (a) of the current frame in accordance with a difference in size relation of the data values between the current frame Fn and the previous frame Fn−1. If the most significant bit data (a) inputted from the current frame Fn are greater than those from the previous frame Fn−1, the most significant bit data (a) inputted to the current frame Fn, that is, the normal driving data of Table 2 are added to the look-up table data. On the contrary, if the most significant bit data (a) inputted from the current frame Fn are smaller than those from the previous frame Fn−1, the most significant bit data (a) of the current frame Fn, that is, the normal driving data of the Table 2 are subtracted from the look-up table data.

For example, in the look-up table data of Table 3, the value '3' is obtained from the look-up table data (2,9), which are the most significant bit data inputted into the look-up table 64 that are changed from '2' to '9' between the previous frame Fn−1 and the current frame Fn. The value '3' of the look-up table data (2,9) becoming the value '12' of the high-speed driving modulated data (2,9) in Table 1. The value '3' of the look-up table data (2,9) is then added with the value '9', which is currently inputted. On the other hand, in the look-up table data of Table 3, the value '3' is for the look-up table data (13,9) representing that the most significant bit data MSB inputted to the look-up table 64 between the previous frame Fn−1 and the current frame Fn are changed from '13' to '9'. For the value '3' of the look-up table data (13,9) becoming the value '6' of the high-speed driving modulated data (13,9) as shown in Table 1, the value '3' of the look-up table data (2,9) is added with the value '9', which is currently inputted. The process of the look-up table data (2,9) for such a high-speed driving scheme is performed by the adder 65, the subtracter 66, the MUX 68, and a comparator 67.

The adder 65 adds the most significant modulated data (a) inputted from the current frame Fn and the look-up table data |D| of the look-up table LUT 64 and supplies to a first input terminal of the MUX 68.

The subtracter 66 subtracts the look-up table data |D| of the look-up table LUT 64 from the most significant modulated data (a) inputted from the current frame Fn, to supply to a second input terminal of the MUX 68.

The comparator 67 compares the most significant bit data (a) of the current frame Fn inputted from the most significant bit bus line 62 with the most significant bit data (b) of the previous frame Fn−1 delayed by the frame memory 63. If the most significant bit data (a) of the current frame Fn are greater than those of the previous frame Fn−1, the comparator 67 generates a MUX control signal of high-logic '1'. Conversely, if the most significant bit data (a) of the current frame Fn are smaller than those of the previous frame Fn−1, the comparator 67 generates a MUX control signal of low-logic '0'.

The MUX 68 responds to the MUX control signal from the comparator 67 and selects one of the output signals of the adder 65 and subtracter 66. If a logical value of the MUX control signal is high-logic '1', the MUX 68 selects the output signal of the adder 65. On the contrary, if a logical value of the MUX control signal is low-logic '0', the MUX 68 selects the output signal of the subtracter 66.

The data selected by the MUX 68 satisfies conditions of the high-speed driving scheme as in the following equations ① to ③.

$$VDn < VDn\text{-}1 \dashrightarrow MVDn < VDn \quad \text{①}$$

$$VDn = VDn\text{-}1 \dashrightarrow MVDn = VDn \quad \text{②}$$

$$VDn > VDn\text{-}1 \dashrightarrow MVDn > VDn \quad \text{③}$$

In the above equations, VDn−1 represents a data voltage of the previous frame, VDn is a data voltage of the current frame, and MVDn represents a modulated data voltage.

Figure 7:
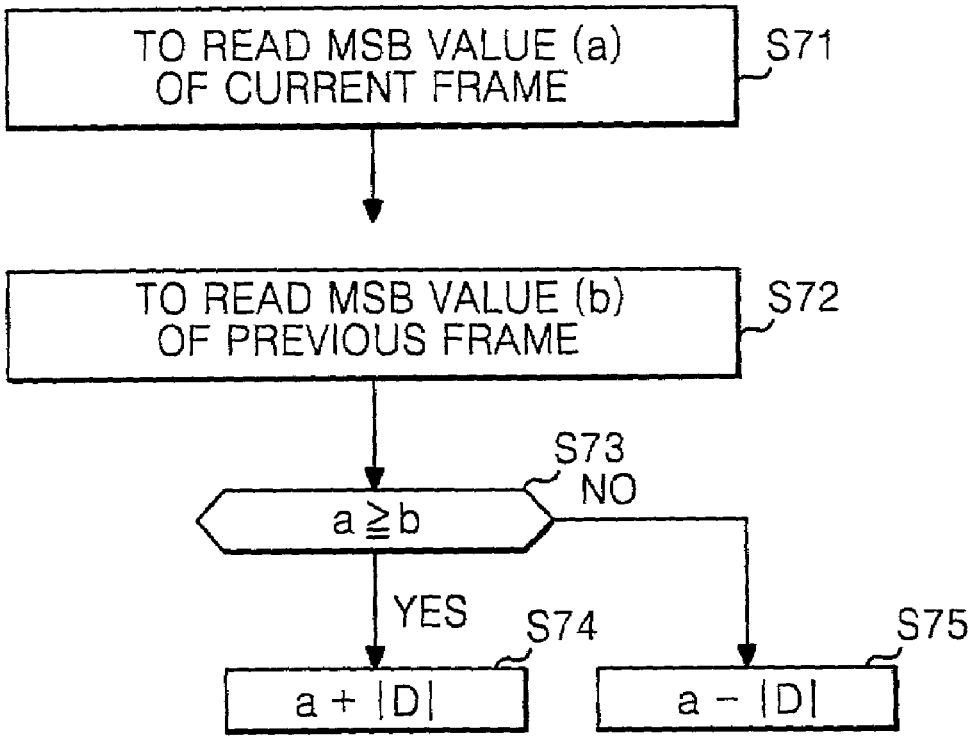
FIG. 7 is a flow chart illustrating a modulating procedure of the data modulator shown in FIG. 6.

Such a data modulation method is arranged in a flow chart as shown in FIG. 7.

Referring to FIG. 7, the data modulator 62 derives the most significant bit data (a, b) from each of the current frame Fn and the previous frame Fn−1 (steps 71 and 72).

The derived most significant bit data (a, b) are compared by the comparator 67 (step 73).

If the most significant bit data (a) of the current frame Fn are greater than those of the previous frame Fn−1 in step 73, the data added by the adder are selected (step 74). Conversely, if the most significant bit data (a) of the current frame Fn are smaller than those of the previous frame Fn−1 in step 73, the subtracted data by the subtracter are selected (step 75).

Figure 8:
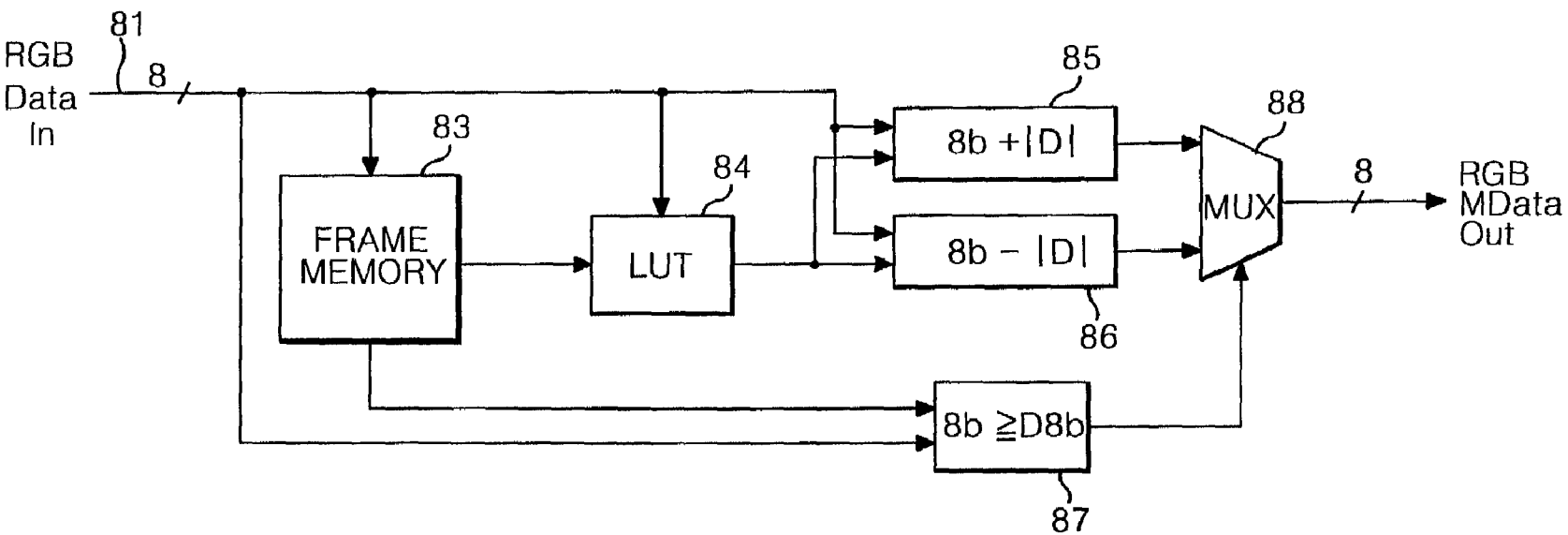
FIG. 8 is a block diagram of a data modulator shown in FIG. 5 according to a second embodiment of the present invention.

FIG. 8 shows the data modulator 52 according to a second embodiment of the present invention.

Referring to FIG. 8, the data modulator 52 according to the second embodiment includes a frame memory 83 receiving a full bit (i.e., 8 bits) of the most significant bit data MSB is inputted from the timing controller 51. A look-up table LUT 84 modulates the full bit data as an absolute value of the difference calculated by subtracting the normal driving data from the modulated data suitable for the high-speed driving scheme. An adder 85 adds the data from an input line 81 and the modulated data from the look-up table LUT 84. A subtracter 86 subtracts the data from the input line 81 and the modulated data from the look-up table LUT 84. A MUX 88 selects one of the output of the adder 85 and the subtracter 86. A comparator 87 controls the MUX 88.

The frame memory 83 stores the full bit data inputted from the timing controller 51 through the input line 81 for a frame period. The frame memory 83 supplies the stored full bit data to the look-up table 84 every frame.

The look-up table 84 has registered look-up table data |D| determined as an absolute value of the difference calculated by subtracting the inputted current normal driving data from the data set in advance for the high-speed driving scheme. Because the look-up table data |D| is determined as an absolute value of the difference, a data width thereof is set smaller than that of the source data 8*b* with a full bit. Assuming that each source data 8*b* of the previous frame Fn−1 and the current frame Fn inputted to the look-up table 84 is 8 bits and that the data width of the look-up table data |D| is set to 7 bits or 6 bits, a memory size of the look-up table 84 is smaller than 459 kbits or 393 kbits, respectively, as shown in the following Table 4.

TABLE 4

| Data width of a look-up table data | Memory size of a look-up table |
|---|---|
| 7 bits | 65536 × 7 = 457 kbits |
| 6 bits | 65536 × 6 = 393 kbits |

The adder 85 adds the full bit source data 8*b* inputted to the current frame 85 with the look-up table data |D| of the look-up table 84 and supplies to a first input terminal of the MUX 88.

The subtracter 86 subtracts the look-up table data |D| of the look-up table 84 from the full bit source data 8*b* inputted to the current frame 85 and supplies to a second input terminal of the MUX 88.

The comparator 87 compares the source data 8*b* of the current frame Fn inputted from the input line 81 with a data D8*b* of the previous frame Fn−1 one frame delayed by the frame memory 83. If the source data 8*b* of the current frame Fn are greater than those of the previous frame Fn−1, the comparator 87 generates a MUX control signal having high-logic '1'. Conversely, if the source data 8*b* of the current frame Fn are smaller than those of the previous frame Fn−1, the comparator 87 generates a MUX control signal having low-logic '0'.

The MUX 88 responds to the MUX control signal from the comparator 87 and outputs one of the output signals of the adder 85 and subtracter 86. If a logical value of the MUX control signal is high-logic '1', the MUX 88 selects the output signal of the adder 85. On the contrary, if a logical value of the MUX control signal is low-logic '0', the MUX 88 selects the output signal of the subtracter 86.

The data selected by the MUX 88 satisfies conditions of the high-speed driving scheme as shown in the equations ① to ③.

Figure 9:
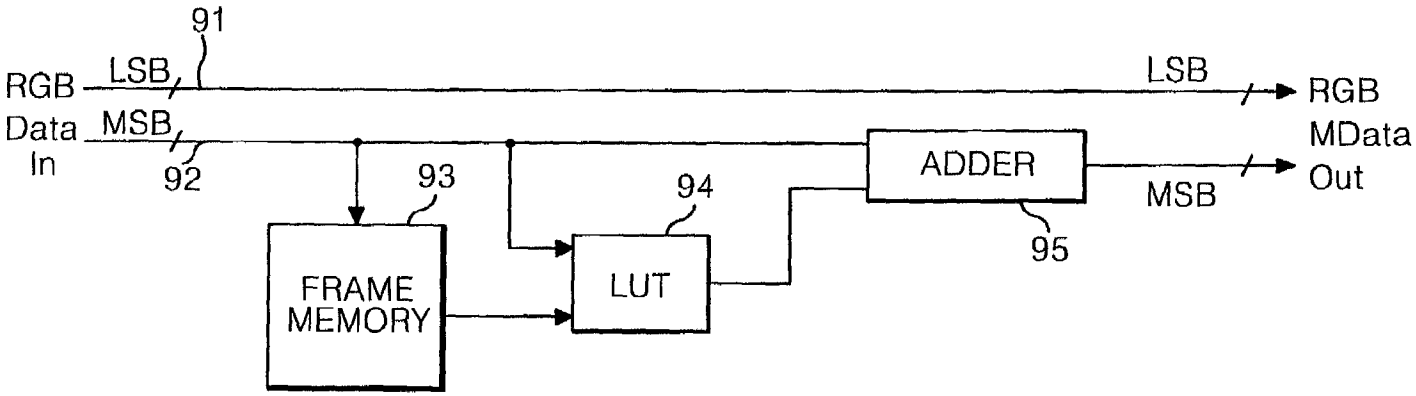
FIG. 9 is a block diagram of a data modulator shown in FIG. 5 according to a third embodiment of the present invention.

FIG. 9 illustrates the data modulator 52 according to a third embodiment of the present invention, Referring to FIG. 9, the data modulator 52 according to the third embodiment includes a frame memory 93 receiving most significant bit data MSB from the timing controller 51 (shown in FIG. 5). A look-up table 94 modulates the most significant bit data in accordance with a difference calculated by subtracting the normal driving data from the modulated data suitable for a high-speed driving scheme. An adder 95 adds the modulated data from the look-up table 94 and the data from a significant bit bus line 92.

More specifically, a frame memory 93 is connected to a most significant bit bus line 92 of the timing controller 51 and stores the most significant bit data MSB inputted from the timing controller 51 for a frame period. The frame memory 93 supplies the stored most significant bit data MSB to the look-up table 94 every frame.

The look-up table 94 has registered look-up table data determined as an absolute value of a difference calculated by subtracting the inputted current normal driving data from the data set in advance suitable for the high-speed driving scheme. The look-up table data have a sign added to Table 3, so that they become Table 5. Consequently, a memory size of the look-up table 84 increases by 1 bit added for a sign bit to the memory, as shown in FIG. 6. Nevertheless, since a data value of the look-up table 94 is determined as the above-mentioned difference value, it becomes smaller than that of the conventional look-up table.

TABLE 5

| | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 0 | 0 | 0 | 1 | 1 | 2 | 2 | 3 | 3 | 3 | 3 | 4 | 4 | 3 | 2 | 1 | 0 |
| 1 | 0 | 0 | 0 | 1 | 1 | 2 | 3 | 3 | 3 | 3 | 3 | 3 | 3 | 2 | 1 | 0 |
| 2 | 0 | 0 | 0 | 0 | 1 | 2 | 2 | 2 | 2 | 3 | 3 | 3 | 3 | 2 | 1 | 0 |
| 3 | 0 | 0 | 0 | 0 | 1 | 1 | 2 | 2 | 2 | 2 | 2 | 3 | 2 | 2 | 1 | 0 |
| 4 | 0 | −1 | −1 | −1 | 0 | 1 | 1 | 2 | 2 | 2 | 2 | 2 | 2 | 2 | 1 | 0 |
| 5 | 0 | −1 | −2 | −1 | −1 | 0 | 1 | 1 | 1 | 2 | 2 | 2 | 2 | 2 | 1 | 0 |
| 6 | 0 | −1 | −2 | −2 | −1 | −1 | 0 | 1 | 1 | 1 | 1 | 2 | 2 | 2 | 1 | 0 |
| 7 | 0 | −1 | −2 | −2 | −2 | −1 | −1 | 0 | 0 | 1 | 1 | 1 | 2 | 1 | 1 | 0 |
| 8 | 0 | −1 | −2 | −2 | −2 | −2 | −1 | −1 | 0 | 0 | 1 | 1 | 1 | 1 | 1 | 0 |
| 9 | 0 | −1 | −2 | −2 | −2 | −2 | −2 | −1 | −1 | 0 | 0 | 1 | 1 | 1 | 1 | 0 |
| 10 | 0 | −1 | −2 | −3 | −3 | −3 | −2 | −2 | −1 | −1 | 0 | 0 | 1 | 1 | 1 | 0 |
| 11 | 0 | −1 | −2 | −3 | −4 | −3 | −3 | −2 | −2 | −2 | −1 | 0 | 0 | 1 | 1 | 0 |
| 12 | 0 | −1 | −2 | −3 | −4 | −4 | −3 | −3 | −3 | −2 | −2 | −1 | 0 | 0 | 1 | 0 |
| 13 | 0 | −1 | −2 | −3 | −4 | −4 | −4 | −4 | −4 | −3 | −2 | −1 | −1 | 0 | 0 | 0 |
| 14 | 0 | −1 | −2 | −3 | −4 | −5 | −5 | −5 | −5 | −4 | −3 | −2 | −1 | 0 | 0 | 0 |
| 15 | 0 | −1 | −2 | −3 | −4 | −5 | −6 | −6 | −6 | −5 | −4 | −2 | −1 | 0 | 0 | 0 |

In Table 5, a furthermost left column is for a data voltage VDn−1 the previous frame Fn−1 while an uppermost row is for a data voltage VDn of the current frame Fn. A minus sign is added to the look-up table data in accordance with the condition of the equation ①. On the other hand, nothing is added to the look-up table for positive integers in accordance with equations ② and ③. The look-up table data of Table 5 having both signs may be changed to the high-speed driving data of Table 1 if they are simply added to the normal driving data of Table 2.

The adder 95 adds the most significant modulated data of the current frame Fn as shown in Table 2, with the look-up table data as shown in Table 5, of the look-up table 94. In this way, the data added by the adder 95 satisfies the conditions of the high-speed driving scheme from equations ① to ③.

Figure 10:
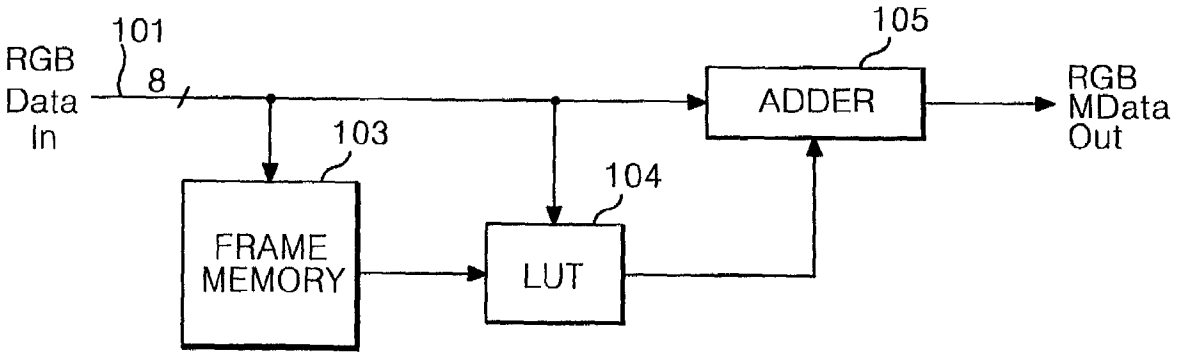
FIG. 10 is a block diagram of a data modulator shown in FIG. 5 according to a fourth embodiment of the present invention.

FIG. 10 illustrates the data modulator 52 according to a fourth embodiment of the present invention.

Referring to FIG. 10, the data modulator 52 according to the fourth embodiment includes a frame memory 103 receiving full bit data MSB having 8 bits are inputted from the timing controller 51 (shown in FIG. 5). A look-up table 104 modulates the full bit data based on a difference calculated by subtracting the normal driving data from the modulated data suitable for a high-speed driving scheme. An adder 105 adds the modulated data from the look-up table 104 and the data from an input line 101.

A frame memory 103 stores the full bit data MSB inputted from the timing controller 51 through the input line 101 for a frame period. The frame memory 103 also supplies the full bit data MSB to the look-up table 104 every frame.

The look-up table 104 has registered a look-up table data determined as a difference calculated by subtracting the inputted current normal driving data from the data set in advance suitable for the high-speed driving scheme. A sign bit as shown in Table 4 is added to the look-up table data. Although the sign bit is added, a data width of the look-up table data is smaller than that of the full bit source data because the look-up table data are determined by the above-mentioned difference.

The adder 105 adds the full bit source data inputted to the current frame Fn with the look-up table data as shown in Table 4. The data added by the adder 105 satisfies the conditions of the high-speed driving scheme of equations ① to ③.

As described above, according to the present invention, the modulated data are determined by the difference calculated by subtracting the normal driving data from the high-speed driving data set in advance, or the absolute value of the difference. As a result, a memory size of the look-up table is reduced, and a picture quality is improved as much because the input data are modulated for compensating a response time of the liquid crystal. Furthermore, although the data are modulated by a full bit comparison, and generated as in a full bit, a memory size of the look-up table becomes small and a degree of freedom in the value determination of the modulated data increases in the present invention.

The data modulator may be implemented by other means, such as a program and a microprocessor for carrying out this program, rather than a look-up table. Also, the present invention may be applicable to all fields where a data modulation is needed, such as communication, optical media, other digital flat panel displays including liquid crystal displays and etc.

It will be apparent to those skilled in the art that various modifications and variations can be made in the method and apparatus for driving the liquid crystal display of the present invention without departing from the spirit or scope of the inventions. Thus, it is intended that the present invention covers the modifications and variations of this invention provided they come within the scope of the appended claims and their equivalents.

What is claimed is:

1. A method of driving a liquid crystal display, comprising steps of:

setting a modulation data in the liquid crystal display;

receiving an input data;

delaying the input data;

modulating the input data using the modulation data in accordance with the input data and the delayed input data;

adding the modulated data to the input data;

subtracting the modulated data from the input data;

comparing the delayed input data with the input data; and selecting one of the added data and the subtracted data depending on the compared result.

2. A method of driving a liquid crystal display, comprising steps of:

receiving an input data;

dividing the input data into most significant bits and least significant bits;

delaying the most significant bits for a frame period;

modulating the most significant bits using the modulation data in accordance with the most significant bits and the delayed most significant bits;

adding the modulated data to the non-delayed most significant bits;

subtracting the modulated data from the non-delayed most significant bits;

comparing the delayed most significant bits with the non-delayed most significant bits; and selecting one of the added data and the subtracted data depending on the compared result.

3. The method according to claim 2, further comprising:

combining the selected data with the least significant bits.

4. A method of driving a liquid crystal display, comprising:

determining a data for driving video data normally;

determining an output data for displaying on the liquid crystal display;

acquiring a modulation data by calculating differences between the normal data and the output data;

storing the modulation data in the liquid crystal display; and receiving an input data;

dividing the input data into most significant bits and least significant bits;

delaying the most significant bits for a frame period;

modulating the most significant bits using the modulation data in accordance with the most significant bits and the delayed most significant bits;

adding the modulated data to the non-delayed most significant bits;

subtracting the modulated data from the non-delayed most significant bits;

comparing the delayed most significant bits with the non-delayed most significant bits; and selecting one of the added data and the subtracted data depending on the compared result.

5. The method according to claim 4, further comprising:

combining the selected data with the least significant bits.

6. A driving apparatus for a liquid crystal display, comprising:

an input line receiving an input data;

a frame memory delaying the input data;

a modulator modulating the input data using the delayed input data;

an adder adding the modulated data to the input data;

a subtracter subtracting the modulated data from the input data;

a comparator comparing the input data with the delayed input data for a frame period; and a selector selecting one of the added data and the subtracted data depending on the compared result from the comparator.

7. A driving apparatus for a liquid crystal display, comprising:

an input line receiving an input data;

a frame memory delaying most significant bits of the input data;

a modulator modulating the most significant bits using the delayed most significant bits and the non-delayed most significant bits;

an adder adding the modulated data to the non-delayed most significant bits;

a subtracter subtracting the modulated data from the non-delayed most significant bits;

a comparator comparing the non-delayed most significant bits with the delayed most significant bits; and a selector selecting one of the added data and the subtracted data depending on the compared result from the comparator.

8. The driving apparatus according to claim 7, further comprising a combiner combining the selected data with the input data.

9. A driving apparatus for a liquid crystal display, comprising:

a modulator storing a modulation data predetermined by calculating differences between a data for driving video data normally and an output data for displaying on the liquid crystal display;

an input line receiving an input data;

a frame memory delaying most significant bits of the input data;

an adder adding a modulated data acquired by the modulator using the non-delayed most significant bits and the delayed most significant bits to the non-delayed most significant bits;

a subtracter subtracting the modulated data from the non-delayed most significant bits;

a comparator comparing the delayed most significant bits with the non-delayed most significant bits; and a selector selecting one of the added data and the subtracted data depending on the compared result.

10. The driving apparatus according to claim 9, further comprising a combiner combining the selected data with the input data.

* * * * *